United States Patent [19]

Nelson et al.

[11] Patent Number: 5,010,707

[45] Date of Patent: Apr. 30, 1991

[54] RETAINING WALL BLOCK MODULE

[76] Inventors: Ned Nelson, 3 Lake Bellevue Dr., Suite 200; William H. Duesenberg, 3 Lake Bellevue Dr., Suite 100, both of Bellevue, Wash. 98005

[21] Appl. No.: 396,088

[22] Filed: Aug. 21, 1989

[51] Int. Cl.[5] ..... E04B 5/04

[52] U.S. Cl. ..... 52/605; 52/606; 52/608; 52/610

[58] Field of Search ..... 52/604, 605, 606, 608, 52/610, 611

[56] References Cited

U.S. PATENT DOCUMENTS

| | | | |
|---|---|---|---|
| 250,635 | 12/1881 | McLean . | |
| 721,825 | 3/1903 | Normandin . | |
| 802,593 | 10/1905 | Peabody . | |
| 1,064,498 | 6/1913 | Landis . | |
| 1,339,388 | 5/1920 | Hauss . | |
| 1,410,953 | 3/1922 | Peirce et al. | 52/605 |
| 1,415,197 | 5/1922 | Sampson . | |
| 1,428,470 | 9/1922 | Brainerd | 52/605 |
| 1,578,861 | 3/1926 | Squire . | |
| 1,659,326 | 2/1928 | Meyercord . | |
| 2,064,791 | 12/1936 | Faber . | |
| 2,141,035 | 12/1938 | Daniels | 52/604 X |
| 2,160,773 | 5/1939 | Wolfe . | |
| 2,234,797 | 3/1941 | Burner . | |
| 2,313,363 | 3/1943 | Schmitt . | |
| 3,422,588 | 1/1969 | Steward, Jr. | 52/605 X |
| 3,472,031 | 10/1969 | Kelso . | |
| 4,050,254 | 9/1977 | Meheen et al. . | |
| 4,067,166 | 1/1978 | Sheahan . | |
| 4,107,894 | 8/1978 | Mullins | 52/606 X |
| 4,132,498 | 1/1979 | Ikeda et al. . | |
| 4,190,384 | 2/1980 | Neumann . | |
| 4,592,678 | 6/1986 | McNinch, Jr. et al. . | |
| 4,731,279 | 3/1988 | Isshiki | 52/606 X |
| 4,875,803 | 10/1989 | Scales | 52/608 X |

FOREIGN PATENT DOCUMENTS

| | | | |
|---|---|---|---|
| 585617 | 9/1933 | Fed. Rep. of Germany . | |
| 527704 | 7/1921 | France | 52/604 |
| 2379660 | 10/1978 | France | 52/606 |
| 143285 | 8/1980 | German Democratic Rep. | 52/604 |
| 345117 | 12/1936 | Italy | 52/608 |
| 107808 | 1/1925 | Switzerland | 52/610 |

OTHER PUBLICATIONS

"Wallstone, An Interlocking Retaining Wall for Garden Landscaping", Westcon Construction Products, 3 pages.

"Slope-Stone", Westcon Construction Products, 3 pages.

"Technical Manual, Keystone Retaining Wall Systems", 13 pages with 1 page insert, (Geogrid Placement Chart).

*Primary Examiner*—Richard E. Chilcot, Jr.
*Assistant Examiner*—Lan Mai
*Attorney, Agent, or Firm*—David L. Garrison

[57] ABSTRACT

A retaining wall is described using multiple pre-cast concrete block modules positioned in stacked horizontal rows with multiple vertical concrete columns which interlock each horizontal row. Each block, which is designed and manufactured to interlock with other like modules, includes a body having at least one vertical side, a leg connecting means attached to a vertical side, and a central passageway. In the preferred embodiment, a leg is attached to and extends laterally from the body with a compatible connecting means formed on the end surface of the leg which interconnects with a leg connecting means located on the body. An alignment means may be formed on the top and bottom surface of the body and used to align stacked block modules. During the wall's assembly, the modules are positioned side-by-side and interconnected in a horizontal row either on the ground or on a pre-constructed continuous concrete footing. End or corner block modules are used when desired. Subsequent horizontal rows of modules are then stacked above the first horizontal row until the desired wall height is achieved. Vertical concrete columns are then poured into the column space created by aligning the central passageways on stacked modules to interlock the horizontal rows of modules.

8 Claims, 4 Drawing Sheets

FIG. 10
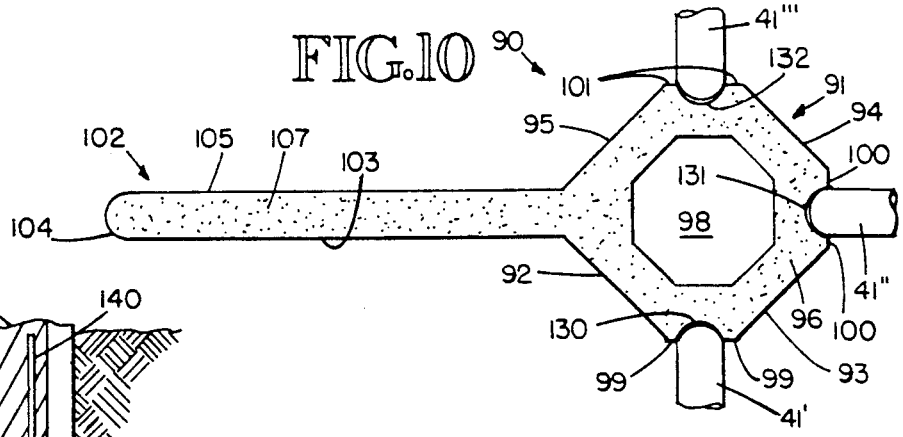
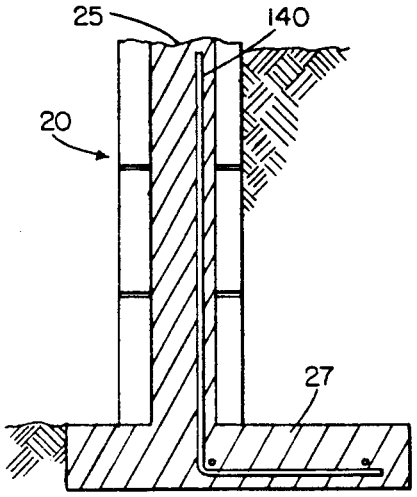
FIG. 13
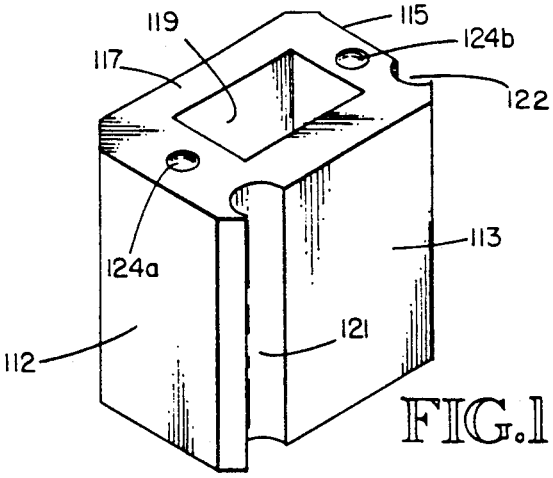
FIG. 11
FIG. 14
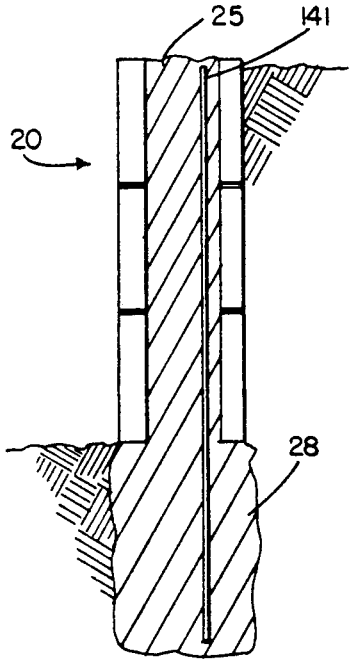
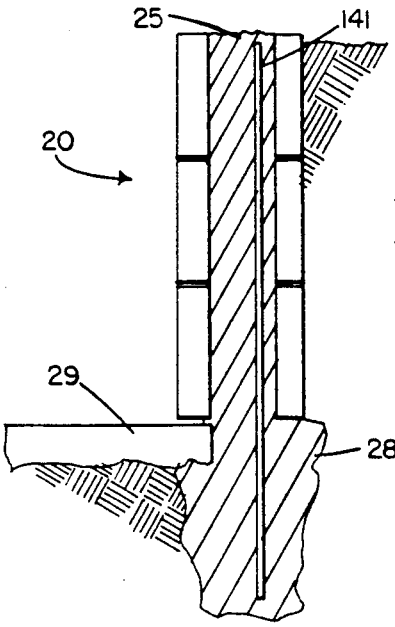
FIG. 15

RETAINING WALL BLOCK MODULE

TECHNICAL FIELD

This invention relates to an apparatus and a method for constructing a retaining wall structure. More particularly, this invention relates to a precast, concrete block module and a method for constructing a retaining wall.

BACKGROUND ART

Retaining walls are often necessary to protect different elevations of soil against erosion. The retaining wall structure can be built in various sizes, shapes and directions for different terrains and adverse conditions. In some instances, it may be desirable to construct a retaining wall structure that is designed to withstand large lateral forces. In still other instances, it may be desirable to build a curved retaining wall structure or a straight retaining wall structure having inside or outside corners. A lightweight, block module that could be used with other like block modules to build a retaining wall having these qualities would be highly desirable.

There are several types of block-like structures presently available for building wall structures.

McLean (U.S. Pat. No. 250,235) discloses the use of a prefabricated, interlocking, rectangular glass blocks having a full length groove and a full length tongue which are stacked one upon the other to build a glass retaining wall to hold back seawater.

Schmid (U.S. Pat. No. 2,313,363) describes a prefabricated retaining wall using blocks made from undisclosed material which has a tongue for positioning an upper block above a lower block and with the upper block slightly offset from the lower block.

Sampson (U.S. Pat. No. 1,415,197) discloses an L-shaped tile structure with a grooved upper edge and a tongue on a lower edge to fit upper and lower tiles. The tiles are placed in alternating positions forming cavities which may be filled with concrete.

Landis (U.S. Pat. No. 1,064,498) discloses L-shaped, artificial stone building blocks, with no hollow main body, which are abutted and joined with other like building blocks to build a wall structure.

None of these references disclose a lightweight, precast, concrete block module which can be used with other like block modules to build a multi-directional, self-supporting retaining wall structure.

DISCLOSURE OF THE INVENTION

It is a general object of the invention described below to provide an economical, lightweight, pre-cast, concrete block module that can be lifted easily by one individual and that can be used in conjunction with a plurality of other modules to build a retaining wall structure.

It is another object of the invention described below to provide a pre-cast, concrete block module that can be used to build a self-supporting retaining wall that is predictably designed to withstand the forces found in typical field conditions.

It is another object of the invention described below to provide a single, pre-cast, concrete block module that interlocks with other like modules to build a retaining wall structure.

It is another object of the invention described below to provide an adjustable pre-cast, concrete block module that can be positioned in different directions within the retaining wall structure to build angled or straight retaining wall sections and inside and outside corners.

It is a still further object of the invention described below to provide a method for making a retaining wall structure using the pre-cast, concrete block modules disclosed herein.

It is a still further object of the invention to describe a method for manufacturing the concrete block modules disclosed herein.

These objects and features as well as other incidental advantages will become more apparent during the course of the following disclosure.

The retaining wall structure disclosed herein is comprised of one or more horizontal rows of interconnecting block modules and multiple, vertical concrete columns, cast in place to interlock the horizontal rows of modules. Each block module is comprised of a body portion having at least one leg extending laterally therefrom and a vertically disposed central passageway. The body portion, hereinafter referred to as the body, is substantially square or rectangular in cross section and includes a vertical front surface, a vertical rear surface, a vertical inside surface, a vertical outside surface, a horizontal top surface, and a horizontal bottom surface. In the first embodiment, a leg member, hereinafter referred to as the leg, extends laterally from the vertical inside surface of the body. The leg includes a vertical front surface, a vertical rear surface, a vertical end surface, a horizontal top surface, and a horizontal bottom surface. A diagonal support member extends between the inside surface of the body and the rear surface of the leg to provide support to the leg. An alignment means may be manufactured on the top and bottom surfaces of the body and used to align the module with a superjacent and a subjacent module. A complimentary leg connecting means is formed in the outside or rear surface of the body which, during assembly of the retaining wall structure, interconnects with the vertical end surface of the leg on an adjacent module.

In another embodiment, the diagonal support member is eliminated and replaced with a rib member which extends horizontally along the rear surface of the leg from the vertical inside surface of the body to approximately the end surface of the leg.

In a third embodiment, the block module includes an elongated hollow body which has a substantially octagonal cross section and includes a horizontal top surface, a horizontal bottom surface, and eight vertical side surfaces. A leg, much like the leg described with the first and second embodiments, extends laterally from a side surface. The body has a plurality of complementary leg connecting means, each formed along a vertical side surface which, during assembly of the retaining wall structure, may be interconnected with the vertical end surface of a leg on an adjacent block module. During assembly of two or more intersecting retaining wall structures, the block module is placed at the intersection site. The vertical end surface from each adjacent module is interconnected with one leg connecting means located on the block module, thereby tying the intersecting retaining wall structures together.

A fourth embodiment of this invention, particularly useful as a corner or end block module, comprises a body having a vertical front surface, a vertical rear surface, a first and a second vertical side surface, a horizontal top surface, and a horizontal bottom surface. Each corner or end block module is hollow with a vertically disposed central passageway. One or more leg connecting means may be manufactured on the first or second side surfaces or on the front or rear surfaces which may be interconnected with the vertical end surface of the leg from an adjacent block module. An alignment means may be manufactured on the top and bottom surfaces if desired for vertically aligning the modules with a superjacent and subjacent module.

In the preferred embodiment, the each leg's vertical end surface comprises a vertical, part-cylindrical surface which extends from the leg's top surface to the bottom surface. The leg connecting means located on the body of each module has a shape complementary to the adjoining leg's part-cylindrical end surface and comprises a vertical part-cylindrical recess wherein, during assembly of the retaining wall structure, the end surface of an adjoining leg may be nested. In addition, each block module embodiment, may be manufactured in different sizes and in either a right-handed or a left-handed configuration using conventional concrete industry casting techniques. The exposed surfaces of each of the block modules may be relieved, embossed, or formed with decorative surface features as desired. By using either one or several types of the module blocks, described herein, in either the right-handed or left-handed configuration, or in combination, a self-supporting retaining wall structure may be constructed.

The first step in constructing the retaining wall structure is the selection of the individual block modules. Each block module must be able to interconnect with an adjacent block module and, if necessary, must be able to be aligned with superjacent and subjacent modules. Once the modules are selected, a row of modules is then positioned horizontally side-by-side along the location of the retaining wall structure. The modules may be placed either directly on the ground or on a continuous footing. At the inside or outside corner sites of the retaining wall structure, the first, second, or fourth block module embodiments may be used. The third block module embodiment may be used at the intersection of two or more intersecting retaining wall structures. The fourth block module embodiment may also be used at the ends of the retaining wall structure, if desired.

During assembly of the retaining wall structure, the leg of each first, second, and third block module embodiment extends laterally from the body and interconnects with the leg connecting means located on an adjacent block module. With the preferred embodiment, the leg connecting means, vertical part- cylindrical recess surface enables the leg to be rotated and placed in different positions, if desired.

The retaining wall structure may be constructed using single or multiple horizontal rows of block modules. When constructing a retaining wall using multiple horizontal rows of block modules, each subsequent horizontal row of modules is placed above the lower horizontal row of modules up to a maximum height determined in part by the size and configuration of the block module used. The alignment means located on the top surface of the body of the subjacent module are interconnected with the alignment means located on the bottom surface of the superjacent module to align the stacked modules. When the assembly process is completed, the front surfaces and central passageways of the stacked modules are in vertical alignment and a vertical column space is created.

Once the retaining wall structure is assembled, wet concrete is then placed into each column space to construct a vertical concrete column. When cured, the concrete in each vertical column interlocks the horizontal rows of modules. When all of the vertical columns have been constructed, the retaining wall structure is completed.

BRIEF DESCRIPTION OF THE DRAWINGS

FIG. 6 is a partial plan view showing the interconnection between the complementary leg connecting means located on one block module and the part-cylindrical end surface of the leg on an adjacent block module showing the different possible angled positions adjoining modules can be placed in.

FIG. 10 is a plan view of a third embodiment of the invention having a body substantially octagonal in cross section with multiple leg connecting means located on multiple vertical surfaces and a lateral leg.

FIG. 11 is a perspective view of a fourth embodiment of this invention.

FIG. 13 is a sectional view taken along lines 13—13 of FIG. 1.

FIG. 14 is a sectional view similar to FIG. 13 showing an alternative column footing.

FIG. 15 is a sectional view similar to the views shown in FIGS. 13 and 14 showing the retaining wall structure built next to an adjacent concrete slab.

BEST MODE FOR CARRYING OUT THE INVENTION

Figure 1:
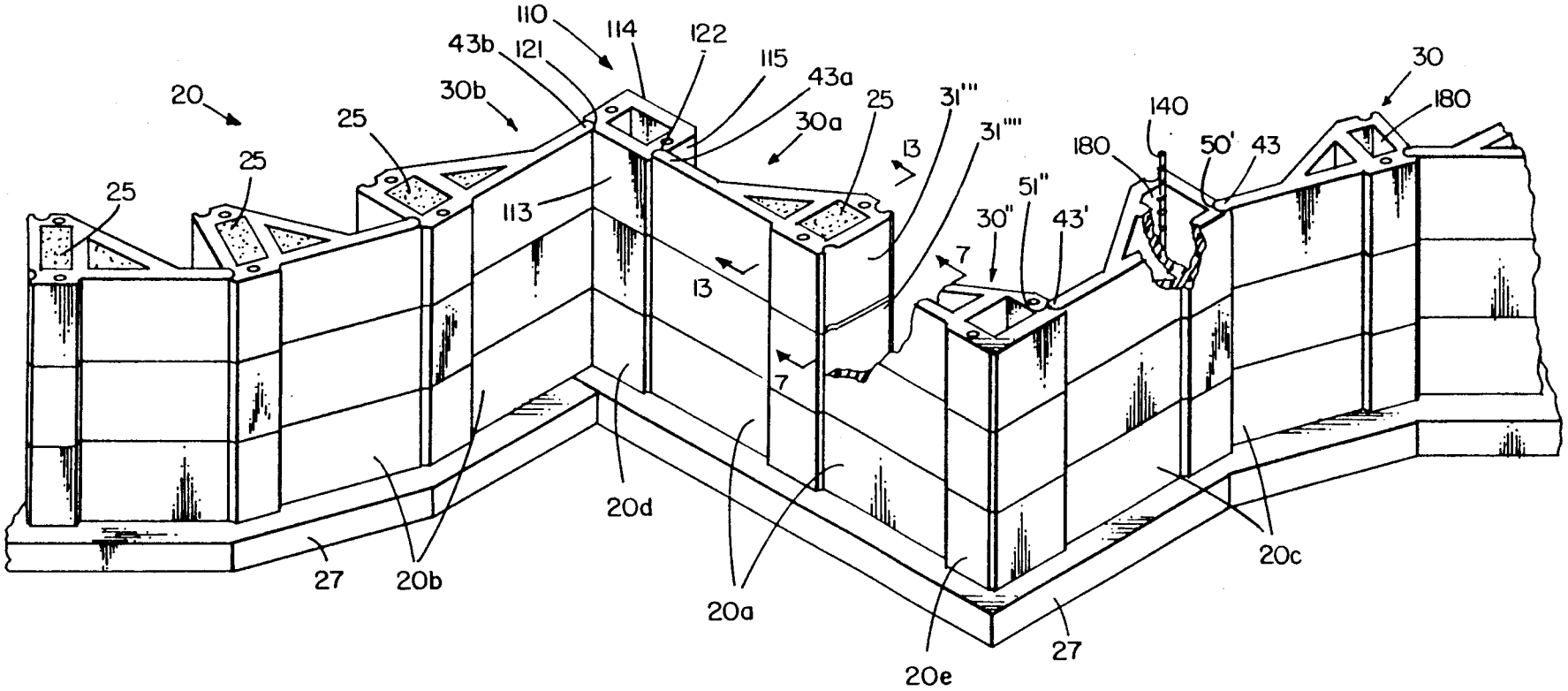
FIG. 1 is a perspective view of a portion of the retaining wall disclosed herein.
Figure 2:
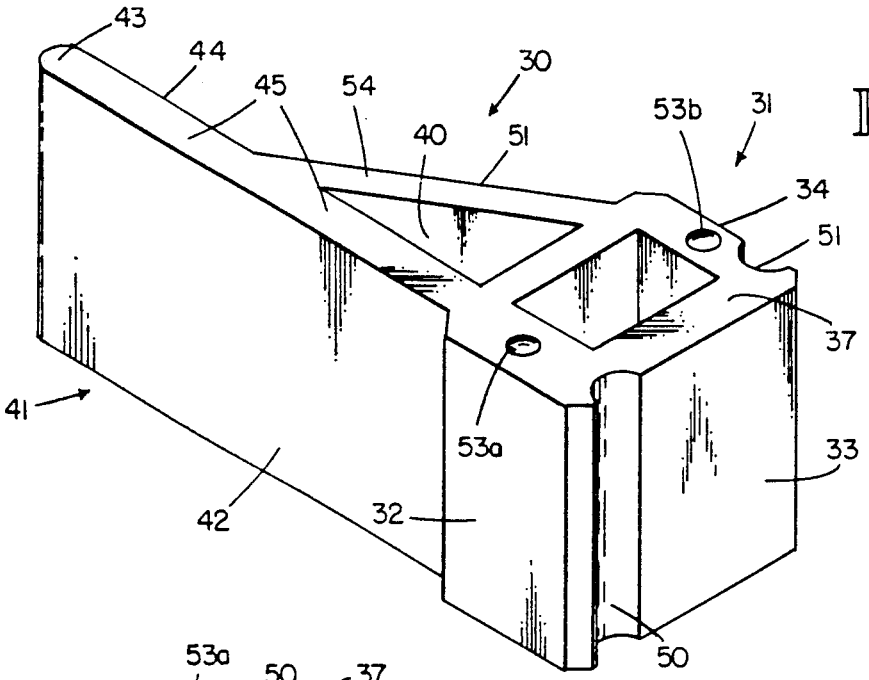
FIG. 2 is a perspective view of a first embodiment of a pre-cast concrete block module.

Referring specifically to the drawings wherein like numerals indicate like parts, there is seen in FIG. 1 a retaining wall generally indicated by number 20 having horizontally and vertically interconnecting multiple concrete block modules 30 and vertically multiple concrete columns 25, which interlock the horizontal rows modules together. The block modules, disclosed herein, which measure approximately 30 inches (L) inches (H)×16 inches (W) and weigh approximately 60 pounds, are designed to construct a self-supporting retaining wall structure approximately six foot high. The size of each block module may be varied to make smaller or larger retaining wall structures. The retaining wall structure 20 may be built to have straight sections 20(*a*), angled sections 20(*b*) and 20(*c*), inside corners 20(*d*), and outside corners 20(*e*).

In the preferred embodiment, shown in FIGS. 2–5, module 30 comprises a body 31, a laterally extending leg 41, and a diagonal support member 51. Body 31, having preferably a substantially square or rectangular cross section, includes a vertical front surface 32, a vertical outside surface 33, a vertical inside surface 35, a vertical rear surface 34, a horizontal top surface 37, and a horizontal bottom surface 38. Leg 41, which may be manufactured in various lengths, extends laterally from the vertical inside surface 35 of body 31. Leg 41 includes a vertical front surface 42, a vertical, part-cylindrical end surface 43, a vertical rear surface 44, a horizontal top surface 45, and a bottom surface 46. Front surface 42 of leg 41 is positioned slightly rearward with respect to front surface 32 by offset 36 which extends vertically from the top surface 37 to bottom surface 38 between the body 31 and leg 41. The part-cylindrical end surface 43 extends vertically between the top surface 45 and the bottom surface 46 of leg 41. The diagonal support member 51 extends horizontally and diagonally from the junction of the inside surface 35 and the rear surface 34 and joins with leg 41 at approximately the mid-point of the rear surface 44. Diagonal support member 51 has a vertical front surface 52, a vertical rear surface 53, a horizontal top surface 54, and a horizontal bottom surface (not shown). The central portion of body 31 from top surface 37 to bottom surface 38 is hollow, creating a vertically disposed central passageway 39. A second vertical passageway 40, which is formed by front surface 52, rear surface 44, and inside surface 35, is located adjacent to the central passageway 39.

A leg connecting means, which has a shape complementary to end surface 43, comprises a vertical part-cylindrical recess surface formed in the vertical side and rear surfaces of module 30. Recess surface 50 is formed in the outside surface 33 near the front surface 32 and recess surface 51 is formed in the rear surface 34 near the outside surface 33. Each recess surface 50 and 51, extends vertically between the top surface 37 and bottom surface 38 of body 31.

Figure 6:
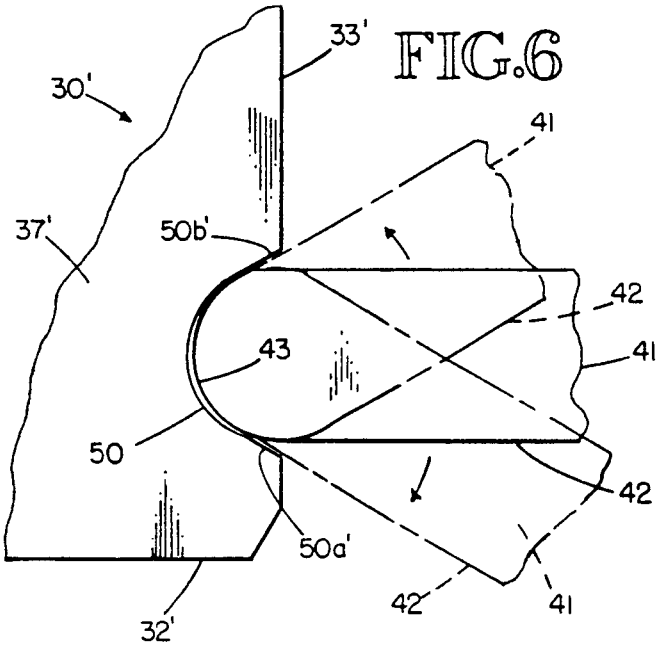

As shown in FIG. 6, during retaining wall assembly, each block module 30 is placed side by side with other like block modules 30, with the part-cylindrical recess surfaces 50, located on block module 30' interengaging the part-cylindrical end surface 43 on block module 30. Part-cylindrical recess surface 50' and part-cylindrical end surface 43 are shaped complementary to each other which enables module 30 to be rotated and placed in different positions with respect to adjoining module 30'. The outer edges **50(*a*)', 50(*b*) of recesses 50' and 51',(not shown), may be angled rearward to increase the angular rotation of block module 30 with respect to block module 30'. By interconnecting the block modules 30 and 30' in this manner, straight 20(*a*) or angled 20(*b*), 20(*c*) wall sections shown in FIG. 1 may be constructed. Alternatively, module 30 may be formed with a part-cylindrical recess surface (not shown) on front surface 32 near the edge between the outside surface 33 and the front surface 32** so that an inside corner may be constructed in the retaining wall structure. Although both end surfaces and recess surfaces are preferably part-cylindrical in shape, they may be formed in any complementary shape which result in the block modules being secured together.

Figure 5:
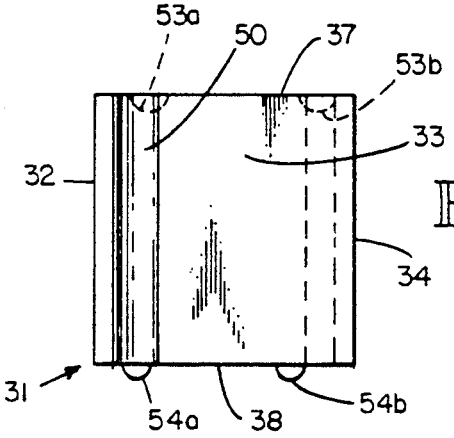
FIG. 5 is a side elevational view of the device shown in FIGS. 2, 3, and 4.
Figure 3:
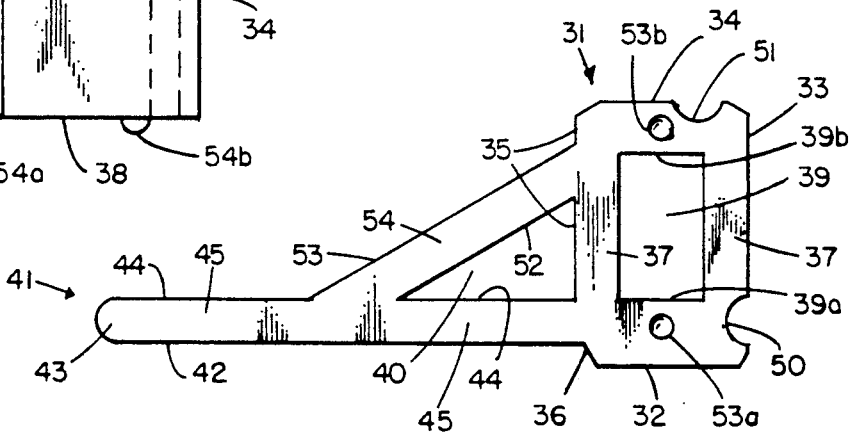
FIG. 3 is a plan view of the device shown in FIG. 2.
Figure 4:
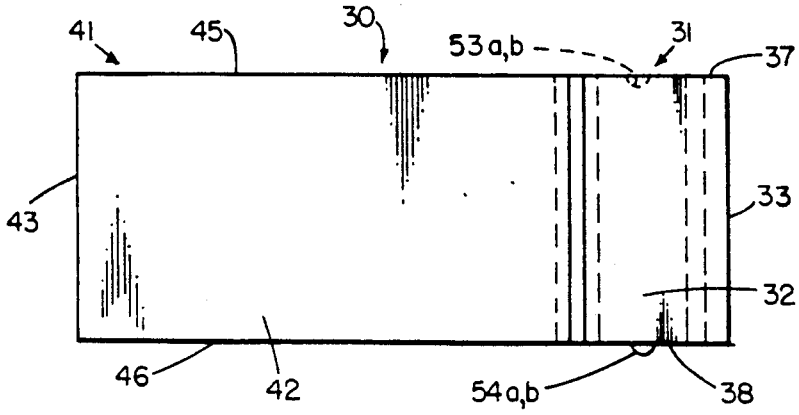
FIG. 4 is a front elevational view of the device shown in FIGS. 2, e, and 4.
Figure 7:
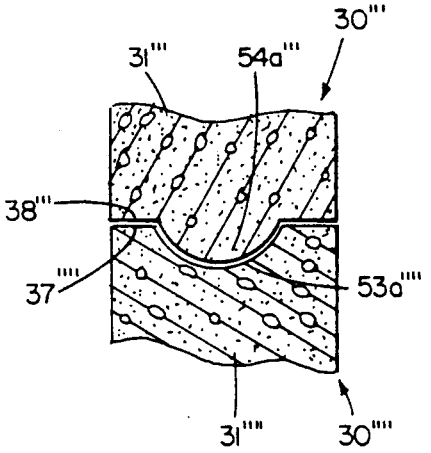
FIG. 7 is a partial cross-sectional view taken along lines 7—7 of FIG. 1 showing complementary alignment means located between the top and bottom surfaces located on stacked block modules.

As shown in FIGS. 3–5, an alignment means comprising a pair of part-spherical recesses **53(*a*) and 53(*b*) located in the top surface 37 of body 31 and a pair of part-spherical projections 54(*a*) and 54(*b*) located on the bottom surface 38 of body 31 are used to align stacked modules. Recess 53(*a*) is located between the front inside surface 39(*a*) of the central opening 39 and front surface 32 while recess 53(*b*) is located between the rear inside surface 39(*b*) of the central opening 39 and rear surface 34. During casting, the alignment projections 54(*a*) and 54(*b*) are vertically aligned with the alignment recesses 53(*a*) and 53(*b*), respectively, which ensures that the front surfaces and central passageways are aligned when the modules are stacked. FIG. 7 shows a cross section of an alignment means positioned on the top surface 37'''' of body 31''– and bottom surface 38''' of body 31''' used to align stacked block modules 30'''' and 30'''**.

Figure 9:
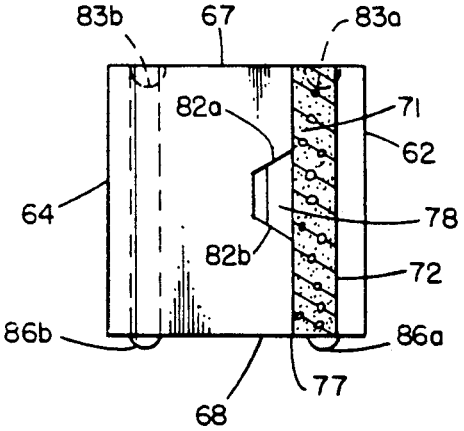
FIG. 9 is a cross-sectional view taken along lines 9—9 of FIG. 8.
Figure 8:
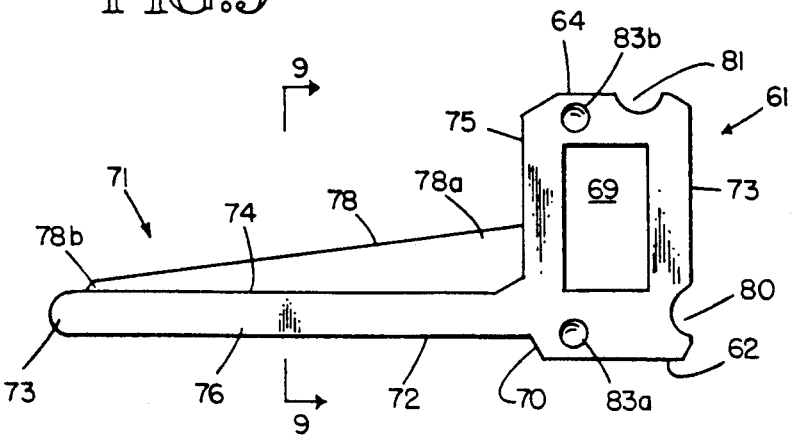
FIG. 8 is a plan view of a second embodiment of the invention having a horizontal rib member located on the rear surface of the leg.

In FIGS. 8 and 9, an alternative block module embodiment 60 is shown having a similar configuration to block module 30 with an elongated rib support member 78 used in place of diagonal support member 51 to reinforce leg 71. Module 60 comprises a body 61, a laterally extending leg 71, and a rib member 78. Body 61, which preferably has a substantially square or rectangular cross section, has a vertical front surface 62, a vertical outside surface 73, a vertical inside surface 75, a vertical end surface 64, a horizontal top surface 67, and a horizontal bottom surface 68. Leg 71, which extends laterally from inside surface 75 of body 61, includes a vertical front surface 72, a vertical, part-cylindrical end surface 73, a vertical rear surface 74, a horizontal top surface 76, and a bottom surface 77. Front surface 72 of leg 71 is positioned slightly rearward with respect to front surface 62 by offset 70, which extends vertically from top surface 67 and bottom surface 68 on body 61. The central portion of body 61 from top surface 67 to bottom surface 68 is hollow creating a vertically disposed central passageway 69. Vertical, part-cylindrical recess surfaces 80 and 81 are formed in the outside surface 73 and rear surface 64, respectively. Rib member 78 is formed along the rear surface 74 of leg 41. Rib member 78 extends horizontally from the vertical inside surface 75 of body 61, beginning at wide portion **78(*a*) and ending at narrow portion 78(*b*) near the end surface 73. As shown in FIG. 9, the top and bottom surfaces 82(*a*) and 82(*b*) of rib member 78 may be slightly angled inwardly during manufacture. An alignment means, comprising a pair of part-spherical recesses 83(*a*) and 83(*b*) located in the top surface 67 of body 61 and a pair of part-spherical projections 86(*a*) and 86(*b*) located on bottom surface 68 of body 61** may also be provided.

In FIG. 10, a third embodiment 90 is shown comprising a hollow body 91 having a substantially octagonal cross section and a laterally extending leg 102. Body 91 comprises a horizontal top surface 96 and a bottom surface (not shown), a central passageway 98, alternating wide vertical surfaces 92, 93, 94, 95, and narrow vertical surfaces 99, 100, and 101. Leg 102, which is similar to leg 41 of block module 30, is formed along one surface of the body 91 and comprises a vertical front surface 103, a rear surface 105, a vertical, part-cylindrical end surface 104, a horizontal top surface 107, and a horizontal bottom surface (not shown). Part-cylindrical surface 104 extends vertically between top surface 107 and the bottom surface. Complementary-shaped leg connecting means' comprising vertical, part-cylindrical recess surfaces 130, 131, and 132 are located on the narrow vertical surfaces 99, 100, and 101, respectively, which each may be interconnected with a part-cylindrical end surface on the leg of the adjacent module. As shown in FIG. 10, at least three adjacent legs 41', 41'', and 41''' may be interconnect with each module 90 at recess surfaces 130, 131, and 132, respectively. By interconnecting the module 90 with the adjacent modules in this manner, module 90 may be used to tie together up to three intersecting retaining wall structures. An alignment means similar to that shown on the other block modules 30 and 60, may be formed on the top and bottom surface 96 and the bottom surface, if desired.

Figure 12:
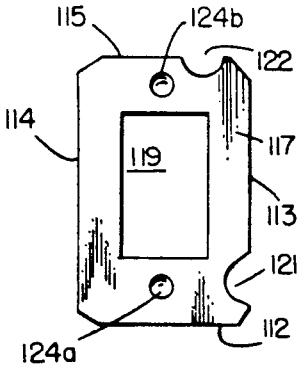
FIG. 12 is a plan view of the device shown in FIG. 11.

The fourth block module embodiment shown in FIGS. 11 and 12 may be used as a corner or end block module in the retaining wall structure 20. Block module 110 is preferably hollow having a substantially square or rectangular cross section with a vertical front surface 112, two vertical side surfaces 113 and 114, a vertical rear surface 115, a horizontal top surface 117, and a horizontal bottom surface (not shown). Alignment means, identical to the alignment means disclosed with block modules 30 and 60, are located on the top surface 117 and bottom surface (not shown), and comprise a pair of half-spherical recesses 124(*a*) and 124(*b*) and a pair of half-spherical projections (not shown) extending from the bottom surface, respectively. The central portion of module 110 is hollow creating a vertical disposed central passageway 119 extending from the top surface 117 to the bottom surface. Located on the side surface 113 and the rear surface 115 are part-cylindrical recess surfaces 121 and 122, respectively, which may be interconnected with the part-cylindrical end surfaces 43, 73, or 103 located on an adjacent module 30, 60, or 90, respectively. In the preferred embodiment, part-cylindrical vertical recess surface 121 is located on side surface 113 near the edge between the side surface 113 and front surface 112. Part-cylindrical vertical recess surface 122 is located on rear surface 115 near the edge between the rear surface 115 and side surface 113. Alternatively, block module 110 may be manufactured with each recess surface 121, 122 manufactured in different locations on each side surface 113 or rear surface 115, respectively, or with a single, part-cylindrical recess surface located on either a side surface 113 or rear surface 115.

The first step in constructing a retaining wall using the herein described block modules is selection of the proper interlocking block modules. Once selected, a first row of block modules is positioned along the desired location of the retaining wall structure either on the ground or on a continuous footing 27, shown in FIGS. 1 and 13. Block module 30, may be lifted manually into position with the front surfaces of each module facing outward and with leg projecting laterally. Each block module is placed adjacent to another module with the part-cylindrical end surface of each leg interconnecting with the part-cylindrical recess surface located on the adjacent block module. As shown in FIG. 6, the part-cylindrical end surface 43 located on leg 41 nests in the recess surface 50, which enables leg 41 to be rotated an placed in different positions with respect to the front surface 32,.

Once the first row of block modules are placed in their desired positions and interconnected, subsequent horizontal rows are then placed above the lower row of block modules until the desired height is achieved. As shown in FIG. 7, block module 30''' is aligned with stacked module 30'''' by engaging the pair of half-spherical projections 54(*a*)''' and 54(*b*)''' (not shown) located on the bottom surface 38''' of body 31''' with the pair of half-spherical recesses 53(*a*)'''' and 53(*b*)'''' (not shown), respectively, located on the top surface 37'''' of body 31''''.

Once all rows of block modules 30 are positioned and aligned, vertical concrete columns 25 are then cast in place inside the column space 180 created by aligning the central passageways 39 on superjacent and subjacent modules. As shown in FIGS. 13, 14, and 15, vertical reinforcement rods 140 and 141 may be placed in each vertical column space 180 as desired. Wet concrete is then placed into the column space 180. When the concrete has cured, a continuous, vertical concrete column 25 interlocks each horizontal row of modules. Once all of the vertical columns 25 have been placed and cured, the retaining wall 20 is complete. The void behind the wall 20 then may be backfilled.

As shown in FIG. 10, when two or more retaining walls intersect, a vertical row of block modules having two or more part-cylindrical recess surfaces on the body thereof are used at the intersection site. Using module 90, the wall is formed by extending leg 102 laterally and interconnecting it with a part-cylindrical recess surface located on the adjacent block module. Legs 41', 41'', 41''' are located on the adjoining modules on each intersecting retaining wall section with part-cylindrical recess surfaces 130, 131, 132, respectively, located on body 91. Additional block modules are then stacked above the lower block module until the desired wall height is achieved. Once the entire retaining wall structure is assembled, a continuous, vertical concrete column is placed and cured in the same manner as described above by placing wet concrete into the column space created by aligning the central openings 98 of stacked modules.

As shown in FIG. 1, block module 30'' may be used to construct an outside corner 20(*e*) by interconnecting end surface 41'' with recess surface 51'' on an adjacent module 30''. Block module 110 may be used to construct an inside corner 20(*d*). During assembly of the inside corner 20(*d*), a right-handed block module 30(*a*) and a left-handed block module 30(*b*) are placed adjacent to the rear 115 and side surface 113 of module 110, respectively. The end surface 43(*a*) located on modules 30(*a*) is interconnected with block module 110 at recess surface 122, and end surface 43(*b*) located on module 30(*b*) is interconnected with block module 110 at recess surface 121. Once placed in proper position and interconnected, successive like modules are then stacked above until the desired wall height is achieved. Once completed, concrete is then poured into the central column opening to construct a continuous concrete vertical column. By using a module 110 with a part-cylindrical recess surface (not shown) manufactured on side surface 114, an outside corner (not shown) may be constructed.

By manufacturing a single, part-cylindrical recess surface in either the side surfaces 113 or 114, or in rear surface 115, module 110 may be also be used as an end block module (not shown) in the retaining wall structure.

As shown in FIGS. 1 and 13, the retaining wall structure 20 may be constructed on a pre-constructed, continuous concrete footing 27. Alternatively, as shown in FIGS. 14 and 15, the retaining wall structure 20 may be assembled on the ground with column footings 28 constructed under each vertical column, either separately placed and cured or formed as an integral part of the vertical column. Moreover, the retaining wall structure 20 may be constructed next to a pre-existing concrete slab 29.

Each module embodiment disclosed herein may be manufactured by using conventional concrete industry molding techniques. The steps include: (1) preparing a form made of wood or some other material for each embodiment, with filler cores being used to form the vertical openings and the rounded recess surfaces; (2) placing concrete under pressure and, if necessary, with vibration into the form and around the filler cores until the form is filled to its top; (3) allowing the concrete to set up until green; (4) removing the block module from the form; and (5) allowing the block to cure.

In compliance with the statute, the invention has been described in language more or less specific as to structural features It is to be understood, however, that the invention is not limited to the specific features shown since the means of construction herein disclosed describes a preferred form of putting the invention into effect. The invention is therefore claimed in any of its forms or modifications within the legitimate and valid scope of the appended claims properly interpreted in accordance with the doctrine of equivalents.

INDUSTRIAL APPLICABILITY

Pre-cast concrete block modules will find wide use among home owners who need a small retaining wall constructed in their yard. The method and the pre-cast concrete block modules disclosed herein will be especially useful in the building and landscaping industries interested in building an inexpensive, easy to construct retaining wall.

I claim:

1. A retaining wall block comprising:
(a) A body having a front surface, a vertical central passageway, and one or more identically shaped vertical recesses;
(b) A leg extending laterally from said body and having a vertical end surface with a shape complementary to that of said recesses, wherein said leg joins said body forwardly of a center of said central passageway, and
(c) a diagonal support disposed between said body and said leg.

2. A block module as recited in claim 1, further comprising complimentary alignment means located respectively on top and bottom surfaces of said body to align two stacked modules.

3. A block module as recited in claim 2, wherein said alignment means comprise a part-spherical recess and a part-spherical projection.

4. The block of claim 1 wherein said body is substantially rectangular.

5. The block of claim 1 wherein said recesses and said vertical end surface are part-cylindrical in shape.

6. The block of claim 1 further comprising first and second recesses, said first recess disposed opposite said leg and said second recess disposed rearwardly of said central passageway.

7. A block module for constructing a retaining wall structure comprising:
(a) a body having at least one vertical surface, a top surface, and a bottom surface, said body having a vertical central passageway extending from said top surface to said bottom surface, said central passageway being formed to receive concrete placed therein to form a structural column;
(b) a leg connecting means located on said vertical surface for connecting said module to an adjacent module;
(c) a leg attached to and extending laterally from said body, said leg having a vertical rear surface and a vertical end surface;
(d) a diagonal support member disposed between said body and said leg.

8. A retaining wall block module comprising:
(a) a body having a front surface, an inside surface, an outside surface, a rear surface, a top surface, and a bottom surface;
(b) a leg laterally projecting from said inside surface of said body, said leg having a front surface, a rear surface, and an end surface, a top surface, and a bottom surface, said front surface of said leg being parallel to said front surface of said body;
(c) a leg connecting means located on said side surface of said body which will engage with said end surface of said leg, whereby when two like said modules are positioned side-by-side, said leg connecting means from one said module may be interconnected with said end surface of said adjacent module, enabling said modules to be keyed together to form a retaining wall;
(d) a diagonal support member disposed between said inside surface of said body and said rear surface of said leg.

* * * * *